US010309128B2

(12) United States Patent
Horton

(10) Patent No.: US 10,309,128 B2
(45) Date of Patent: Jun. 4, 2019

(54) CHANGEABLE LOCK COVER

(71) Applicant: Carrington D. Horton, Corona, CA (US)

(72) Inventor: Carrington D. Horton, Corona, CA (US)

( * ) Notice: Subject to any disclaimer, the term of this patent is extended or adjusted under 35 U.S.C. 154(b) by 0 days.

(21) Appl. No.: 15/674,494

(22) Filed: Aug. 10, 2017

(65) Prior Publication Data

US 2018/0044946 A1 Feb. 15, 2018

Related U.S. Application Data

(60) Provisional application No. 62/373,771, filed on Aug. 11, 2016.

(51) Int. Cl.

| | |
|---|---|
| ***E05B 67/00*** | (2006.01) |
| ***E05B 67/38*** | (2006.01) |
| ***E05C 19/16*** | (2006.01) |
| ***E05B 17/10*** | (2006.01) |
| ***E05B 17/22*** | (2006.01) |

(52) U.S. Cl.

CPC ..... *E05B 67/38* (2013.01); *E05B 17/10* (2013.01); *E05B 17/226* (2013.01); *E05B 67/00* (2013.01); *E05C 19/16* (2013.01); *E05B 2067/386* (2013.01)

(58) Field of Classification Search

CPC ..... E05B 67/38; E05B 17/10; E05B 7/226; E05B 2067/386; E05B 67/00; E05B 17/226; E05C 19/16

USPC ..... 70/54–56, 57.1; 211/4

See application file for complete search history.

(56) References Cited

U.S. PATENT DOCUMENTS

| | | | | | |
|---|---|---|---|---|---|
| 1,805,937 | A * | 5/1931 | Berge | A47G 3/00 | 24/113 MP |
| 4,027,934 | A * | 6/1977 | Wiser | A47B 67/00 | 211/4 |
| 4,286,445 | A * | 9/1981 | Sills | E05B 17/002 | 70/455 |
| 4,356,592 | A * | 11/1982 | Moore | B60N 3/026 | 16/442 |
| 4,534,190 | A * | 8/1985 | Stanich | E05B 67/02 | 70/54 |
| 4,882,918 | A * | 11/1989 | Stanich | E05B 67/02 | 70/54 |
| 5,046,339 | A * | 9/1991 | Krell | E05B 67/02 | 206/523 |

(Continued)

*Primary Examiner* — Suzanne L Barrett

(74) *Attorney, Agent, or Firm* — Kirk A. Buhler; Buhler & Associates

(57) ABSTRACT

Improvements to a changeable lock-cover are disclosed herein. The lock-cover operates with a combination or with a separate version/configuration for a key type lock. Minor geometry differences can be accommodated with the housing that can be made out of a hard plastic or a flexible material that conforms around the lock. The retention of the housing is with magnets, snaps or other temporary securing mechanism. A person can pull apart the closure to mover the cover to another lock or to change the cover to a different color or style. The face or indicia can take a number of different configurations including, but not limited to letters, colors, faces, insignias, moving components, lights, pictures and others. The mechanism that retains the cover together is stronger than the mechanism that holds to face or indicia onto the housing.

19 Claims, 7 Drawing Sheets

(56) References Cited

U.S. PATENT DOCUMENTS 5,082,119 A * 1/1992 Bingley ..... B43M 99/008 211/4
D326,046 S 5/1992 Heald
D345,094 S * 3/1994 Miller ..... D8/346
D379,059 S 5/1997 Turner
D406,045 S 2/1999 Turner
D433,314 S * 11/2000 Mimlitch ..... D8/346
D437,542 S 2/2001 Mimlitch et al.
D446,441 S 8/2001 Brake
D455,639 S 4/2002 McDaid et al.
6,588,638 B1 * 7/2003 Luebeck ..... B60R 11/00 224/279
D525,112 S * 7/2006 Butts ..... D8/334
7,334,437 B2 * 2/2008 Meyer ..... E05B 17/002 70/417
D569,226 S * 5/2008 Brewster ..... D8/346
8,201,427 B1 6/2012 Anderson
D692,745 S * 11/2013 Stevens ..... D8/334
D737,115 S * 8/2015 Weldon ..... D8/346
D752,950 S * 4/2016 Dolce ..... D7/702
2003/0010075 A1 * 1/2003 Rodriguez ..... E05B 17/10 70/432
2003/0102279 A1 * 6/2003 Michael et al. .... E05B 73/0041 215/215
2006/0065024 A1 * 3/2006 Gutierrez ..... E05B 67/02 70/56
2009/0071502 A1 * 3/2009 Drugeon ..... A45C 13/1069 132/293
2011/0167595 A1 * 7/2011 Fiedler ..... A45C 13/1069 24/303
2014/0265377 A1 * 9/2014 Gardner ..... E05B 85/045 292/341.14
2015/0137533 A1 * 5/2015 Kim ..... E05C 19/16 292/251.5
2016/0145910 A1 * 5/2016 Beck ..... E05B 79/04 70/455
2017/0002586 A1 * 1/2017 Lee ..... E05B 47/0012
2017/0009502 A1 * 1/2017 Lahulek ..... E04F 19/086
2017/0021775 A1 * 1/2017 Spector ..... E05C 19/16
2017/0247914 A1 * 8/2017 Waugh ..... E05B 65/48

* cited by examiner

CHANGEABLE LOCK COVER

CROSS REFERENCE TO RELATED APPLICATIONS

This application is a continuation-in-part of applicant's application Ser. No. 62/373,771 filed Aug. 11, 2016 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention relates to improvements in a changeable lock-cover. More particularly, the present changeable lock-cover provides a cosmetic cover for a combination or key lock with an easily removable and replaceable cover to provide a unique and protective personality to the lock.

Description of Related Art Including Information Disclosed Under 37 CFR 1.97 and 1.98

For many people locks provide a level of protection for secured items. With the exception of the combination or the key, combination locks and key locks can all appear to have a similar appearance. For children or others that use a lock, most locks lack personality, and with the exception of a combination or key, the lock essentially appear the same. Over the years there have been a number of patents that have been issued to provide a cosmetic or ornamental cover or jacket to a lock. These provide a protective covering, but don't provide for a personalization.

A number of patents and or publications have been made to address these issues. Exemplary examples of patents and or publication that try to address this/these problem(s) are identified and discussed below.

Over the years there have been a number of different design patents for shells or protective coverings of locks. Specifically, some of these ornamental designs are found in U.S. Design Pat. D326,046, D345,094, D379,059, D406,045, D437,542, D446,441, D455,639, D569,226. While these patents provide an ornamental appearance to cover a lock, they are for the protection of the lock and do not provide any interchangeability of the front face, nor do they provide for interchangeability of parts.

U.S. Pat. No. 8,201,427 issued on Jun. 19, 2012 discloses a Lock Housing. The lock housing operates on a lock drawer where the lock drawer system includes a cabinet drawer having a front wall including a front surface and a rear surface and a combination lock on the drawer with a combination lock dial. While this lock housing provides a cosmetic cover and further provides an opening for a key, dial and combination viewing window, the cover does not have interchangeable faces to customize the housing.

What is needed is a changeable lock-cover that can be easily installed and removed from a combination or key lock and also provides for an interchangeable face, image or other indicia. The proposed changeable lock-cover provides the solution with a cover that can be easily personalized.

BRIEF SUMMARY OF THE INVENTION

It is an object of the changeable lock-cover to operate with a combination or with a separate version/configuration for a key type lock. Minor geometry differences can be accommodated with the housing that can be made out of a hard plastic or a flexible material that conforms around the lock. The cover also provides some protection from physical and environmental conditions.

It is an object of the changeable lock-cover for the lock-cover to be easily installed and removed from a combination or key lock. The retention of the housing is with magnets, snaps or other temporary securing mechanism. This allows a person to quickly and easily customize the cover of the lock with a color or style of their own choosing. The housing essentially hinges over the housing of the lock. A person can pull apart the closure to move the cover to another lock or to change the cover to a different color or style.

It is another object of the changeable lock-cover for the housing to have an interchangeable face or indicia. The interchangeable face or indicia is held on at least one side of the housing and can be changed separately from the lock-cover. The face or indicia can take a number of different configurations including, but not limited to letters, colors, faces, insignias, moving components, lights, pictures and others. The face or indicia all have a common securing mechanism to the lock-cover that allows them to be easily purchased, traded and changed by the user without requiring replacement of the base lock-cover.

It is still another object of the changeable lock-cover for the mechanism that retains the face or indicia that is weaker than the mechanism that holds to housing closed. This allows the user to remove the face or indicia without opening the lock housing cover and potentially dropping the enclosure. One preferred closure and retention mechanism is with magnets where the attraction force can be adjusted and further the magnetic force centers the magnetic polls to make assembly simpler.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
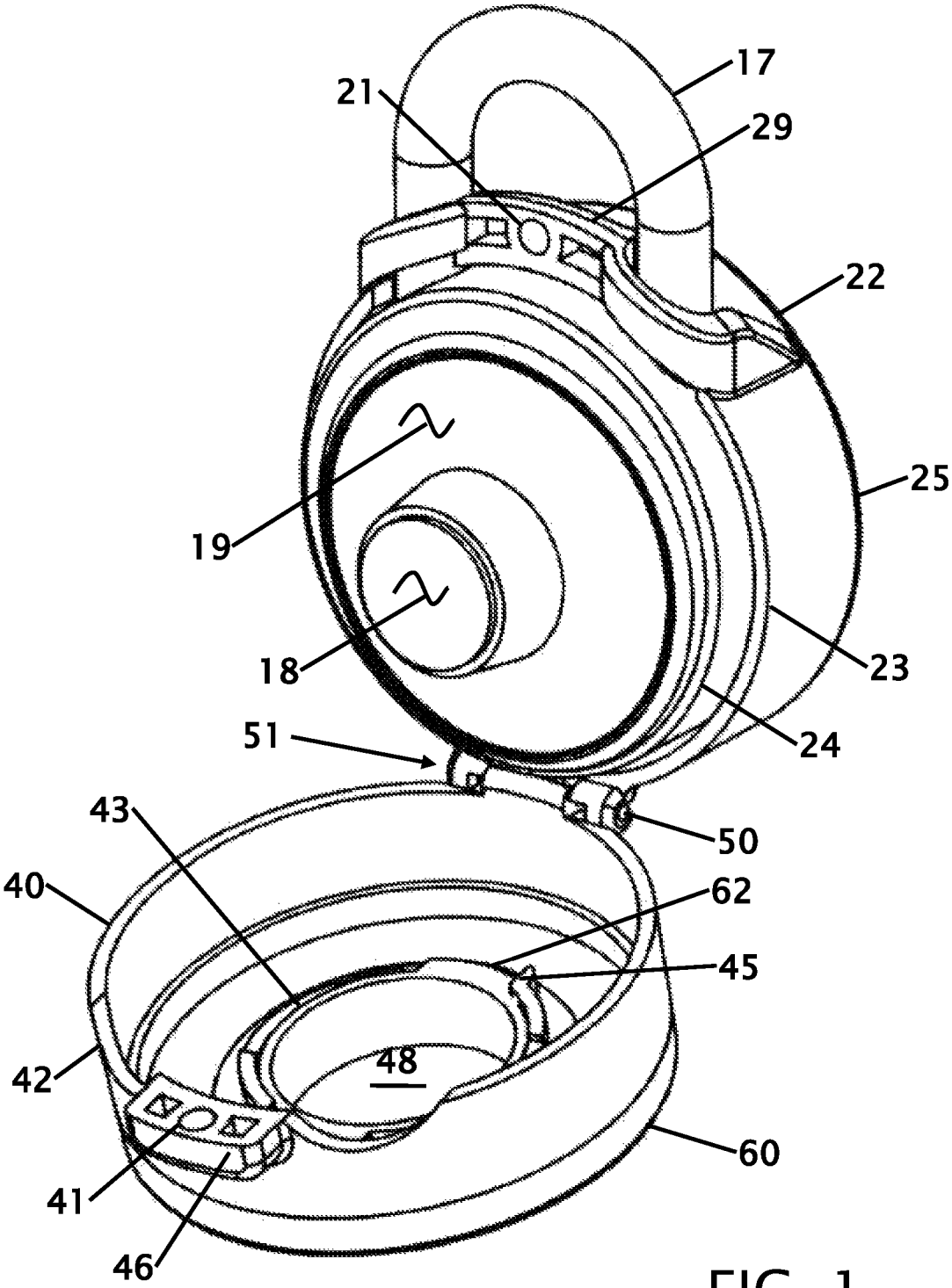
FIG. 1 shows a combination lock in the changeable lock-cover.

FIG. 1 shows a combination lock in the changeable lock-cover. The combination lock has a dial area 19 with a knob 18. A user turns the knob 18 to enter the combination. This type of combination lock is very common in schools. The lock has a shackle 17 that fits through an opening in a cabinet or other apparatus that is being locked. The combination must be correctly entered and one side of the shackle is lifted to remove the shackle 17 from the locker. The lock fits inside of the changeable lock-cover and the shackle 17 fit through an opening or channel 22 in at least one of the housing pieces. A magnet in the back 25 of the housing (not shown in this figure) holds the combination lock against the back of the housing to prevent the housing from falling off the lock when the housing is opened. The side walls 24 of the rear housing essentially surround the combination lock with the shackle passing through the housing. Most of combination locks of the type shown have similar geometry and size and combination locks from different manufacturers can be used with the housing.

An inner wall 24 has a smaller concentric diameter from the outer wall 23. The inner wall 24 provides a step for clearance of the outer wall 40 of the front housing. A hinge 51 pivots on a hinge pin 50 to allow the front housing to swing over and away from the rear housing. The front housing can swing down or to the side. The front housing has a clearance 42 for the shackle when the front housing is secured over the rear housing. The rear housing has a magnetic clasp 21 secured in a wall 29 that is attracted to a complimentary magnetic clasp 41 in a wall 46 in the front housing. These magnets keep the housings closed, and when closed they block access to the combination dial 19 and knob 18. To access the combination dial 19 and knob 18, a gentle pull of the front housing will overcome the magnetic attraction to gain access to the interior of the housing. A recess 48 surrounds the knob 18 to provide a flattened face to the lock-cover.

A removable cover 60 is temporally secured to the front housing. The removable cover 60 is retained with a keyed system having a front face elevated wall 43 with a flat 62 that fits through an opening in the front housing and is turned so the flat contacts a wall surface 45 that prevents further rotation and the cover is secured. The cover can be changed, interchanged or replaced for style, to add personality or a cosmetic difference. Further description of the cover 60 is included later in this document.

Figure 2:
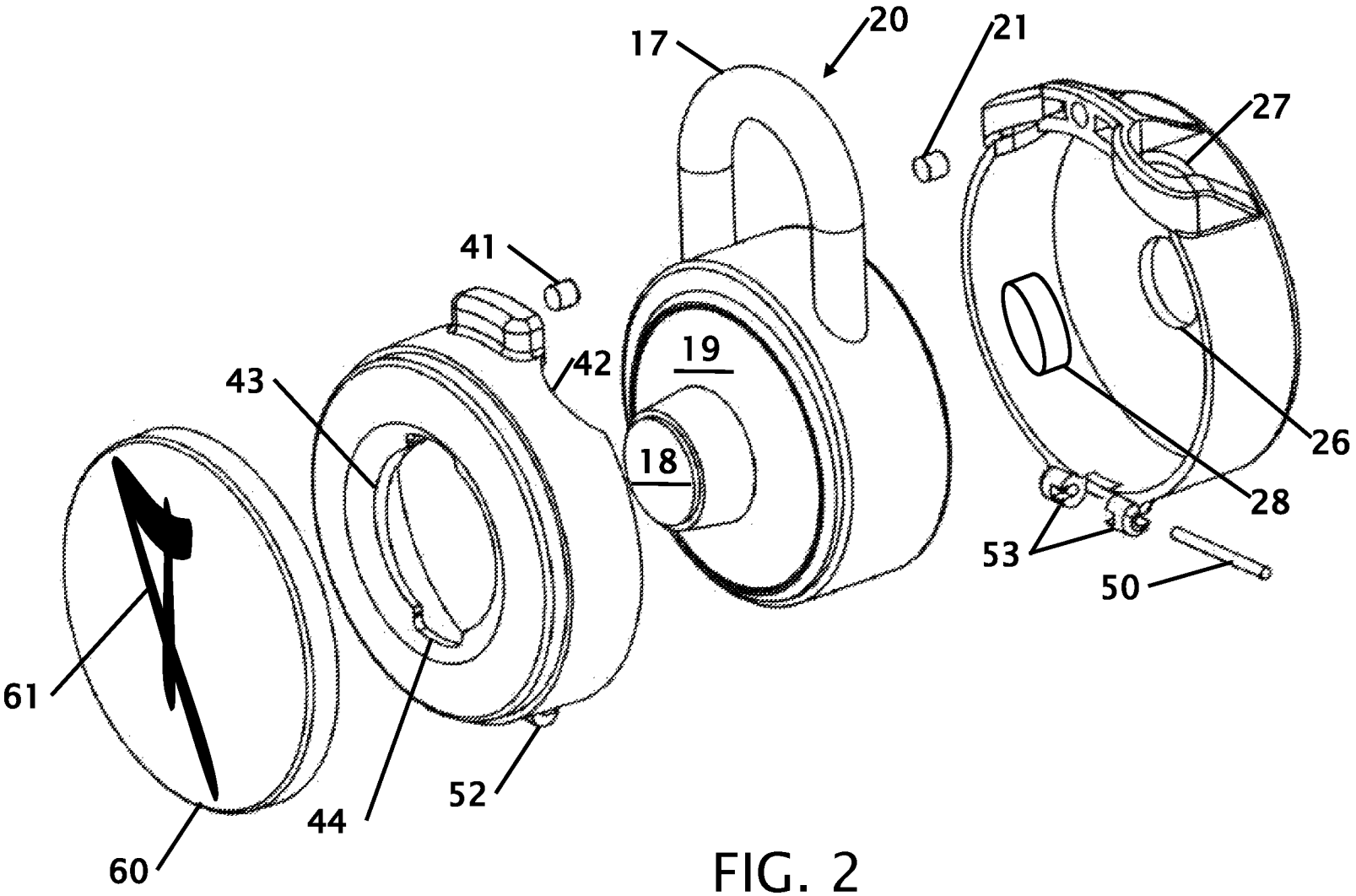
FIG. 2 shows an exploded view of a lock and the changeable lock-cover.

FIG. 2 shows an exploded view of a lock and the changeable lock-cover. This figure shows the combination lock 20 with the rear housing, front housing and cover. The combination lock 20 is shown with a shackle 17 connected to the lock housing with the combination dial 19 and the knob 18. The vertical portions of the shackle 18 fit into the openings 27 that provide clearance for the shackle. To insert the shackle into the rear housing the combination lock 20 is opened and the vertical portions of the shackle 17 is inserted into one opening 27.

A magnet 28 is secured into the recess 26 in the back of the rear housing. This magnet 28 attracts to the metal housing of the lock 20 to hold the combination lock seated in the back housing. Another magnet 21 is placed at the top of the rear housing to keep the front cover closed. The magnetic attraction of the top magnet 21 is not as strong as the magnet 28 that holds the combination lock in the housing. The weaker magnet 21 ensures that the combination lock remains held in the rear housing when the front housing is opened or closed. The bottom of the rear housing a hinge with a through hole that retains a hinge pin 50 that allows the front housing to hinge from the rear housing. The hinge pin is shown on the bottom of the housings, but can also be located on the side of the housings.

The front housing has a loop 52 that connects to the hinge pin 50. The front housing hinges from the hinge pin 50 to provide access to the combination dial. Magnet 41 in the front housing attracts to the magnet 21 in the rear housing to keep the front housing closed on the rear housing. It is contemplated that only one part 21/41 is a magnet and the other component 21/41 is steel or other metal that attracts to the magnet. A recess 42 on the front housing clears the vertical portion of the shackle 17. The front housing has an opening 43 for a key 44. The key 44 allows the cover 60 to engage and retain the cover in the front housing. The cover 60 shown has indicia 61 that adds personality to the cover. While a keyed cover is shown and described, the cover could also be retained with magnets or other mechanism, including but not limited to snaps, tabs or others.

Figure 3:
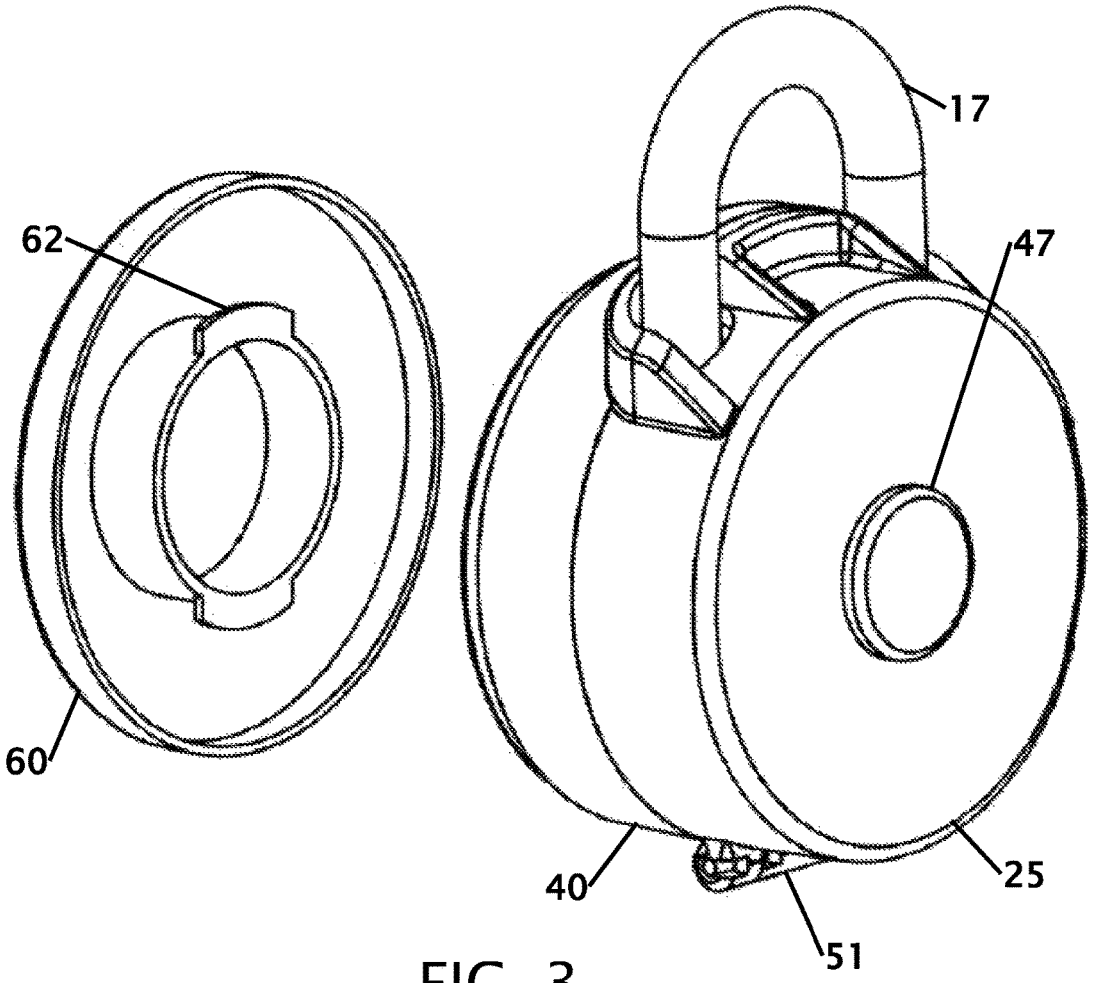
FIG. 3 shows a rear view of the cover displaced from the main housing.

FIG. 3 shows a rear view of the cover displaced from the main housing The bulge 47 in the rear 25 of the back housing holds the magnet 28, not shown in this figure. The shackle 17 is shown extending from the front 40 and rear housing. The hinge pin and hinge support 51 is shown at the bottom of the housing that hinges to the front housing 40. The rear portion of the cover 60 shows the key tabs 62 that engage in the front housing.

Figure 4:
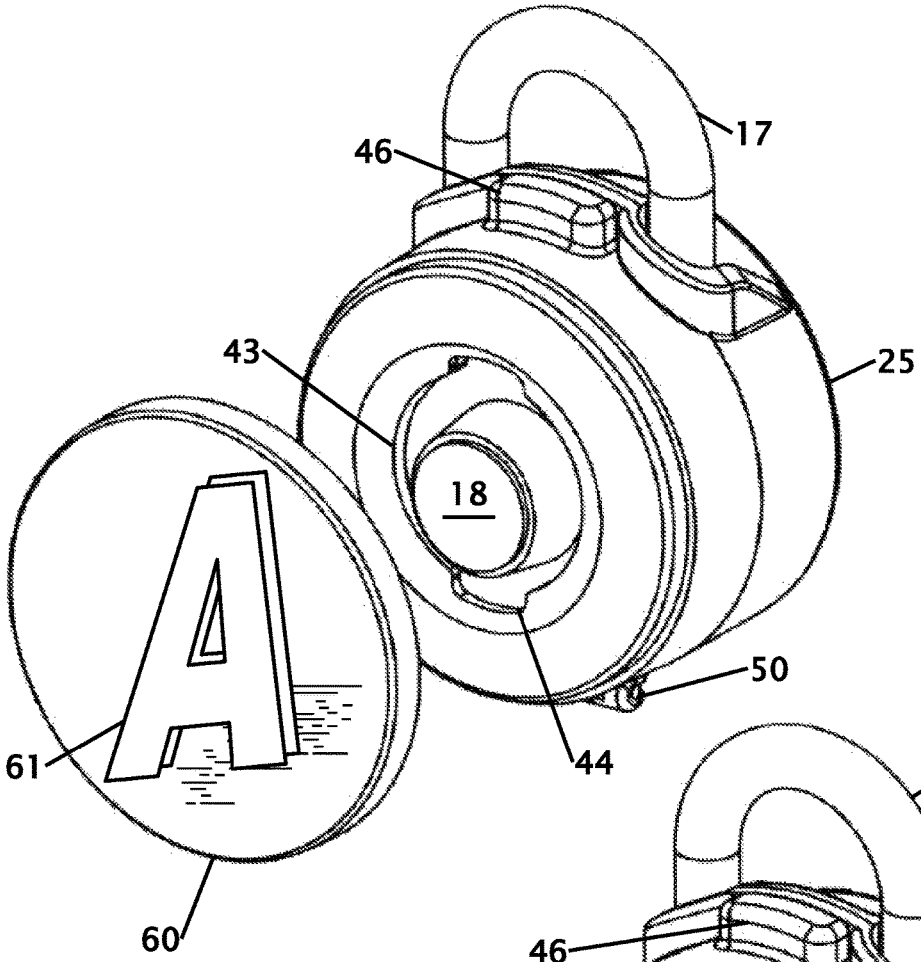
FIG. 4 shows a front view of the cover displaced from the main housing.
Figure 5:
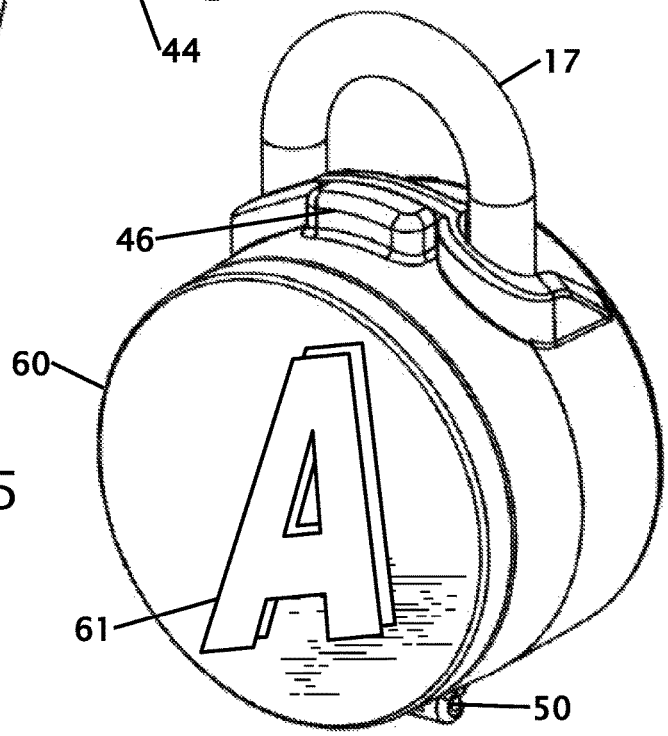
FIG. 5 shows a front assembled view.

FIG. 4 shows a front view of the cover displaced from the main housing and FIG. 5 shows a front assembled view. The cover 60 is removable and interchangeable without requiring replacement of the entire lock-cover. Removal of the cover 60 exposes the knob 18 of the combination lock. The shackle 17 is shown extending from the rear 25 and front housing, and the shackle can be placed through a locker. The bottom of the housing has a hinge pin 50 and the top of the housing has a wall that houses 46 magnetic catch. The front housing shows the opening 43 with the key slot 44 that provides securing of the front cover 60. In the embodiment shown, the front cover can be secured on the front housing in either of two orientations, 180 degrees apart, but other embodiments can allow for only a single orientation or orientations of more than two 180-degree orientations. These figures show indicia of the letter "A", but other indicia are contemplated.

Different indicia 61 is contemplated as well having the housing and/or cover made with/from a neoprene sleeve alternative. Other variations can be Neon-paint or plastics. It is further contemplated that the cover or housing has LED lights that are activated by twist and lock of faceplates. There can also be a plush series for the cover and housing components where all of the components are interchangeable. It is further contemplated that the cover can be powered to provide a clock/time function or motion activated/holographic/simple mechanical movement of ears or tail/ something programmable like simple tech, maybe digital messages or mood emoji's. There can also be custom orders for the cover indicia for pictures of people, pics or pets that are printed, removable or laser engraved. The cover can have a surface texture of Burberry, camouflage, matte, metallic, gloss, wood, bling, etc. A consumer can create aftermarket customizable parts/bling/lettering/painting kits with LOCK-ITS system) like scrapbooking. The cover can be a licensed logo for sports teams or organization including, but not limited to, NBA, NFL, WWE, MLB, MLS, Warner Brothers studios, Disney, Marvell, DC Comics, etc.

Figure 8:
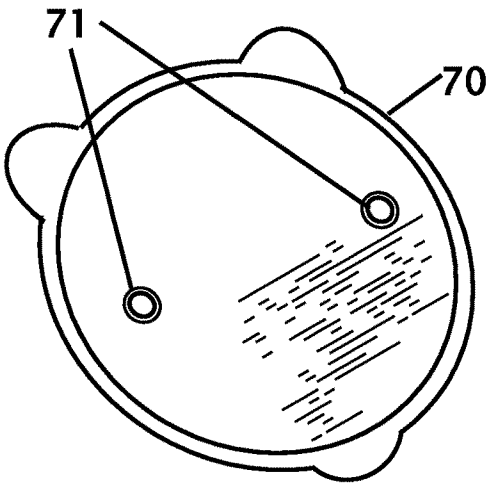
FIG. 8 shows a rear view of the cover.
Figure 7:
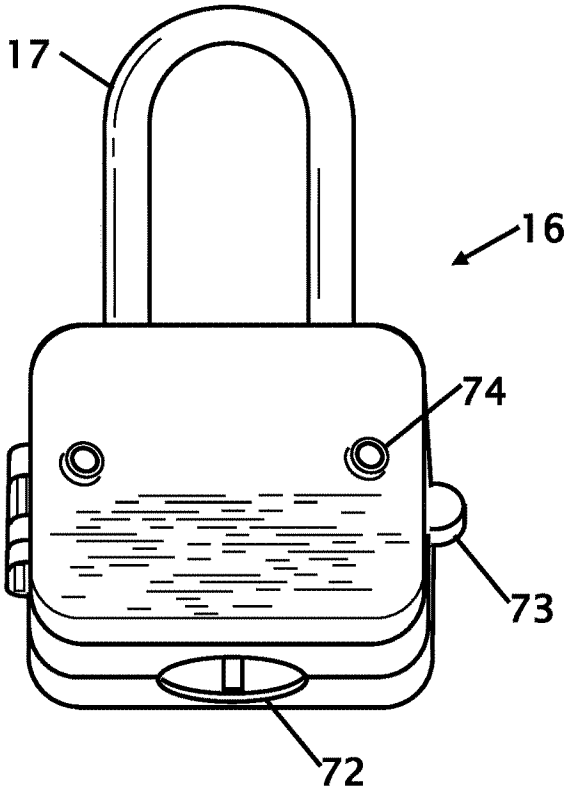
FIG. 7 shows a key lock that accepts the cover.
Figure 6:
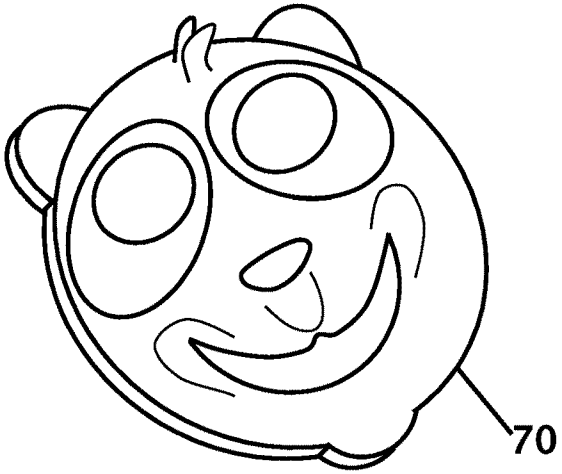
FIG. 6 shows a cover with indicia.

FIG. 6 shows a cover with indicia, FIG. 7 shows a key lock that accepts the cover and FIG. 8 shows a rear view of the cover. This is an embodiment for a key lock 16 cover where the key is inserted into the key hole 72. The shackle 17 extends out of the top of the housing. The construction of the housing is similar to the housing previously described with a front and back housing that is hinged on one side and has a magnetic closure 73 the maintain the housing in a closed orientation. In this embodiment, the cover 70 is retained on the housing with magnets 71 that attract to the magnets 74 in the front housing. The cover 70 can be easily installed and removed by pulling away the magnetic attraction. This magnetic attraction is less than the magnetic attraction of the housing closure 73 to ensure that the main housing does not open with the front cover is removed. The faceplate/front cover 70 can also be magnetically stores on refrigerator or inside of locker.

Figure 9:
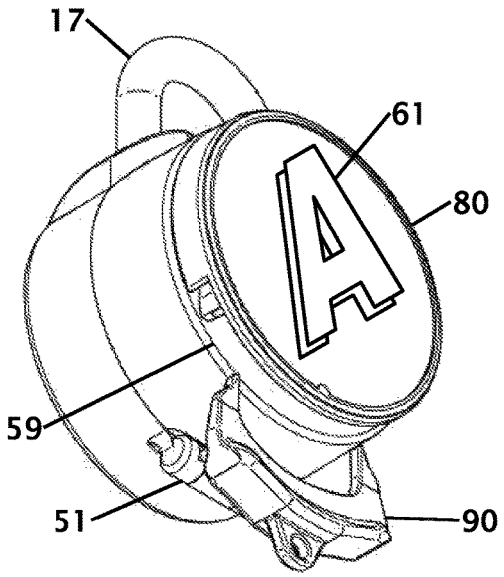
FIG. 9 shows another embodiment of a removable lock cover that requires a key for removal of the removable cover.
Figure 10:
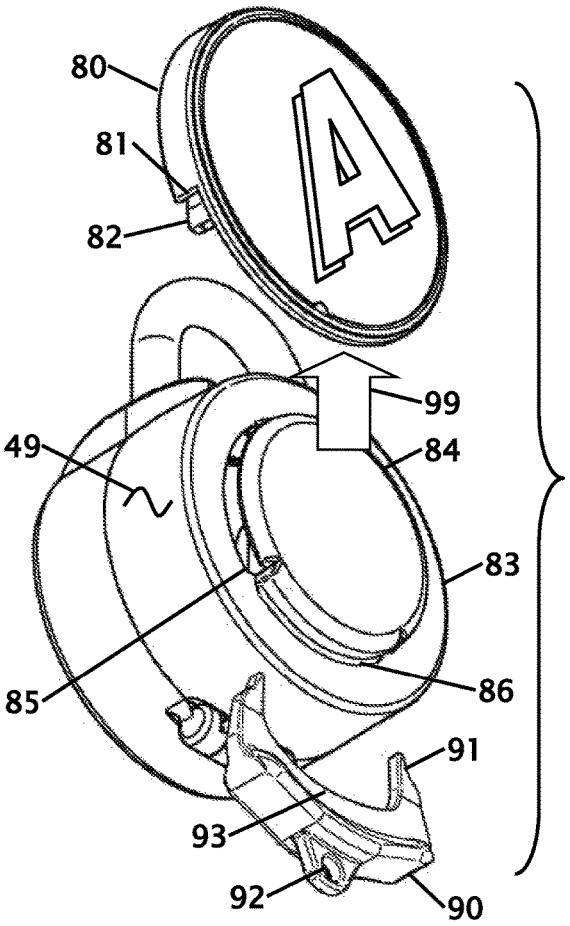
FIG. 10 shows an exploded view of the removable cover that requires a key for removal of the removable cover.

FIG. 9 shows another embodiment of a removable lock cover 80 with indicia 61 that requires a key 90 for removal of the removable cover 80 and FIG. 10 shows an exploded view of the removable cover 80 that requires a key 90 for removal of the removable cover 80. In these figures, the hasp 17 is shown extending out of the enclosure with the hinge 51 that retains the front housing 49 to the rear housing. The cover 80 has an opening 81 on the bottom of the cover 80. Within the removable cover 80 are deformable tabs 82 that retain the cover in the front housing 49. A key 90 slides into an opening 59 between the front housing 49 and the cover 80.

The key 90 has tangs 91 that deform the deformable tabs 82 of the cover 80 to allow the removable cover 80 to be vertically slid 99 off of the front housing 49. The tangs 91 of the key 90 pass between the top face 84 and the surrounding face 83. Insertion of the key 90 is stopped when key 90 wall 93 contacts the wall 86 of the front housing 49. The key 90 has an optional hole 92 to allow the key 90 to be held on a keyring, string or the like.

Figure 11:
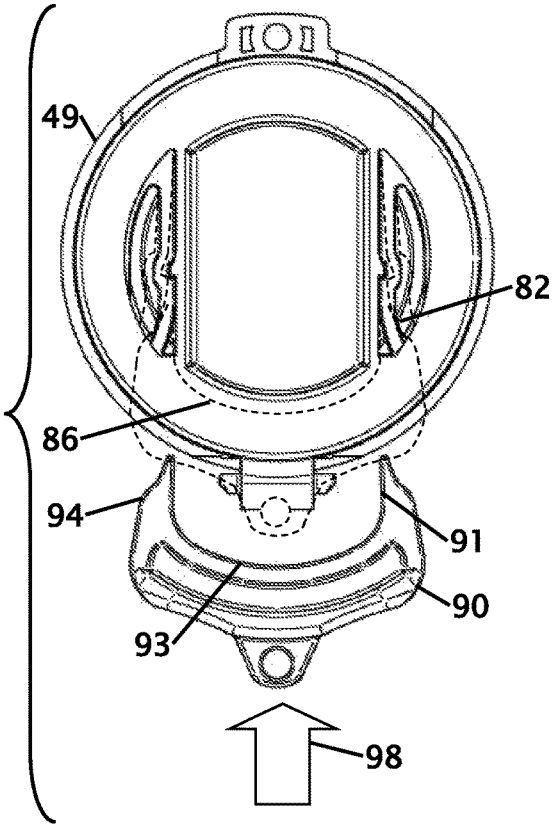
FIG. 11 shows an inside plan view of the front, the removable cover and the key.
Figure 12:
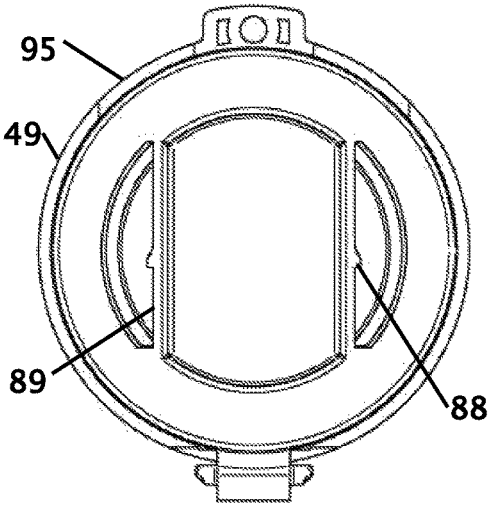
FIG. 12 shows a plan view of the front without the removable cover.
Figure 13:
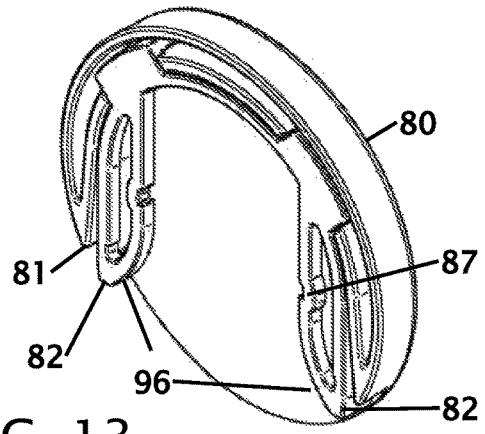
FIG. 13 shows a perspective view of the removable cover.

FIG. 11 shows an inside plan view of the front 49, the removable cover 80 and the key 90, FIG. 12 shows a plan view of the front housing 49 without the removable cover 80 and FIG. 13 shows a perspective view of the cover 80. While FIG. 11 shows the removable cover 80 installed and retained in the front housing 49, FIG. 12 shows the front housing 49 without the cover. In FIG. 11, the key 90 is inserted 98 into between the front housing 49 and the cover 80.

When the key 90 is properly inserted with the wall 93 of the key 90 in contact with the wall 86 of the front housing 49, the tangs 91 and ramps 94 side between the walls 89 of the front housing 49 and push out the deformable tabs 82 of the removable cover 80. This opens the saddle 87 from the tabs 88 in the removable cover 80 to allow the cover 80 to be vertically removed from the front housing 49. While a key 90 is required to remove the cover, ramps 96 allow the deformable tabs 82 to deform and engage the removable cover 80 onto the front housing 49. The deformable tabs 82 slide through an opening 95 in the front housing 49.

Thus, specific embodiments of a changeable lock-cover have been disclosed. It should be apparent, however, to those skilled in the art that many more modifications besides those described are possible without departing from the inventive concepts herein. The inventive subject matter, therefore, is not to be restricted except in the spirit of the appended claims.

SEQUENCE LISTING

Not Applicable.

The invention claimed is:

1. A changeable lock-cover comprising:

a rear housing;

said rear housing having a first rear magnet that is configured to attract and retain a rear of a lock within said rear housing;

a front housing that is hinged to said rear housing;

said front housing has two walls and each of said two walls have a front housing tab on opposing sides of each of said two walls, and said removable cover has two deformable tabs with saddles that are configured to engage into each of said front housing tabs to retain-said removable cover on said front housing;

a retention mechanism that retains said front housing closed on said rear housing;

said retention mechanism being a second magnet in said rear housing and a third magnet in said front housing that are configured to attract and hold said front housing closed on said rear housing;

a clearance in said rear housing and said front housing that is configured for clearance of a shackle, and a removable cover that is temporally secured to said front housing.

2. The changeable lock-cover according to claim 1, wherein said removable cover include indicia.

3. The changeable lock-cover according to claim 1, wherein said rear housing and said front housing is configured to accept a combination or a key lock therein.

4. The changeable lock-cover according to claim 1, wherein said removable cover is textured, camouflage, metallic, gloss and wood.

5. The changeable lock-cover according to claim 1, wherein said removable cover includes a licensed logo or image.

6. The changeable lock-cover according to claim 1, wherein said removable cover engages in said front housing in two rotational orientations.

7. The changeable lock-cover according to claim 1, wherein said removable cover is retained on said front housing with at least two front magnets.

8. The changeable lock-cover according to claim 7, wherein attraction of said second magnet to said third magnet provides less magnetic attraction than said first magnet to said lock.

9. The changeable lock-cover according to claim 1, wherein said a front of said front housing has a fourth magnet and said removable cover has a fifth magnet that is secured to said removable cover, and said removable cover is configured for attraction on a refrigerator or a locker or a metal surface.

10. The changeable lock-cover according to claim 1, wherein said front housing further includes one recess that provides a clearance in said front housing whereby said removable cover engages on said front housing in said one recess.

11. The changeable lock-cover according to claim 1, wherein said removable cover has two tabs located under a front surface of said removable cover that secure said removable cover to said front housing.

12. The changeable lock-cover according to claim 11, wherein said deformable tabs require insertion of a key with a plurality of tangs between said removable cover and said front housing to deform said deformable tabs to disengage said deformable tabs of said removable cover to remove said removable cover from said front housing.

13. A changeable lock-cover comprising:

a rear housing;

said rear housing having a first rear magnet that is configured to attract and retain a rear of a lock within said rear housing;

a front housing that is hinged to said rear housing;

a retention mechanism that retains said front housing closed on said rear housing;

said retention mechanism being a second magnet in said rear housing and a third magnet in said front housing that are configured to attract and hold said front housing closed on said rear housing;

a clearance in said rear housing and said front housing that is configured for clearance of a shackle;

a removable cover that is temporally secured to said front housing, and said removable cover is retained on said front housing with at least two front magnets.

14. The changeable lock-cover according to claim 13, wherein attraction of said second magnet to said third magnet provides less magnetic attraction than said first magnet to said lock.

15. The changeable lock-cover according to claim 13, wherein said removable cover is textured, camouflage, metallic, gloss and wood.

16. The changeable lock-cover according to claim 13, wherein said removable cover includes a licensed logo or image.

17. A changeable lock-cover comprising:

a rear housing;

said rear housing having a first rear magnet that is configured to attract and retain a rear of a lock within said rear housing;

a front housing that is hinged to said rear housing;

a retention mechanism that retains said front housing closed on said rear housing;

said retention mechanism being a second magnet in said rear housing and a third magnet in said front housing that are configured to attract and hold said front housing closed on said rear housing;

a clearance in said rear housing and said front housing that is configured for clearance of a shackle;

a removable cover that is temporally secured to said front housing, and said removable cover has two tabs located under a front surface of said removable cover that secure said removable cover to said front housing.

18. The changeable lock-cover according to claim 15, wherein said deformable tabs require insertion of a key with a plurality of tangs between said removable cover and said front housing to deform said deformable tabs to disengage said deformable tabs of said removable cover to remove said removable cover from said front housing.

19. The changeable lock-cover according to claim 17, wherein said removable cover is textured, camouflage, metallic, gloss, wood, a licensed logo or an image.

* * * * *